United States Patent [19]

Schrotz et al.

[11] Patent Number: 4,486,258

[45] Date of Patent: Dec. 4, 1984

[54] LABELING DEVICE

[75] Inventors: Kurt Schrotz, Beerfelden; Ulf Koch, Eberbach, both of Fed. Rep. of Germany

[73] Assignee: Esselte Pendaflex Corporation, Garden City, N.Y.

[21] Appl. No.: 466,860

[22] Filed: Feb. 16, 1983

[30] Foreign Application Priority Data

Feb. 26, 1982 [DE] Fed. Rep. of Germany ..... 3207053

[51] Int. Cl.[3] ..... B65C 9/30; B65C 11/02

[52] U.S. Cl. ..... 156/384; 29/116 R; 29/126; 156/577; 156/579; 156/582; 156/DIG. 39; 156/DIG. 49

[58] Field of Search ..... 156/384, 541, 555, 574, 156/577, 579, 582, DIG. 39, DIG. 48, DIG. 49, 584; 101/288, 291, 292; 29/116 R, 126

[56] References Cited

U.S. PATENT DOCUMENTS 4,111,735 9/1978 Hamisch, Jr. ..... 156/384

4,116,746 9/1978 Hamisch, Jr. ..... 156/384

4,261,783 4/1981 Finke ..... 156/384

4,301,729 11/1981 Fujita ..... 156/584

*Primary Examiner*—Michael G. Wityshyn

*Attorney, Agent, or Firm*—Gerald J. Ferguson, Jr.; Joseph J. Baker

[57] ABSTRACT

A labeling device is described by means of which adhesive labels can be printed, dispensed, and applied on an article. During each operating cycle an adhesive label is printed in the device and transported into a dispensing position below an applicator roll which is mounted for rotation on an elastically deformable axle. In order to render the applicator roll yieldable to a degree desirable to make it conform to the surface to be provided with an adhesive label, the applicator roll is supported on the axle in a central region of its longitudinal extension, while on either side of said central region there follow axle bore regions extending up to the end faces of the applicator roll in which the latter surrounds the axle with a clearance.

6 Claims, 5 Drawing Figures

FIG. 2
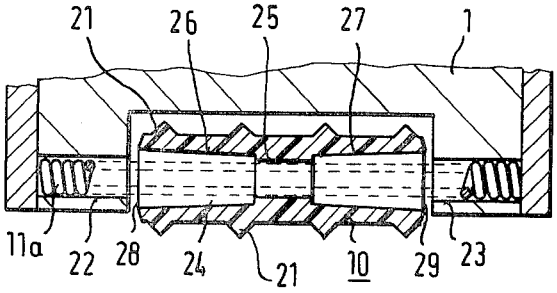
FIG. 3
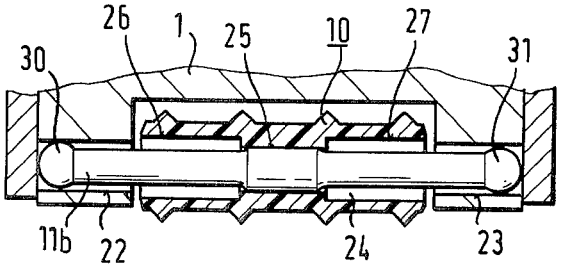
FIG. 4
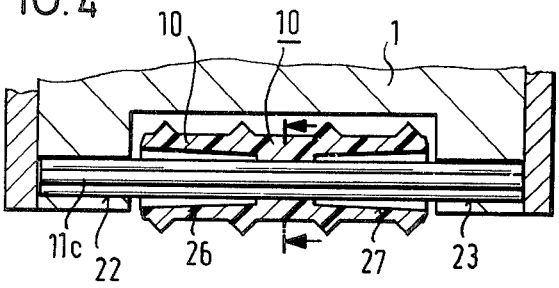
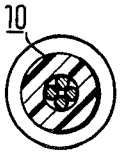
FIG. 5

LABELING DEVICE

The invention relates to a labeling device for printing, dispensing, and applying adhesive labels which, during each operating cycle, prints an adhesive label and transports it into a dispensing position below an applicator roll mounted for rotation on an elastically deformable axle.

Such a labeling device has been known from patent application No. P 30 17 843.9-27. In this known device an axle bore is provided in the applicator roll with a diameter corresponding to the diameter of the axle all along its length. In order to permit the applicator roll to conform to a certain degree to the surface of the article to be provided with a label, a relatively soft plastic material is used for the applicator roll so that the force required for applying the label results in deformation of the applicator roll and thus also in conformation thereof to the surface to be provided with the label. Immediately before being applied on an article the label is printed in the labeling device, and the imprint on the label comes into direct contact with the surface of the applicator roll as the label is applied. Owing to the deformation of the applicator roll when the label is applied the still fresh imprint may be smeared more or less, depending on the degree of deformation, which impairs the quality of the produced imprint. Moreover, the soft plastic material of the applicator roll has the tendency to pick up a portion of the printing ink which is then blotted off in another undesirable location, e. g. on the next following label or on the surface to be provided with the label. The use of an applicator roll with a hard surface in the known device is not possible because then it would not offer the resilience required for neat application of the label.

It is the object of the invention to design a labeling device of the initially defined type so that the resilience required for neat application of a label on a surface is attained without sacrifice of the quality of the imprint on the label.

According to the invention, this object is realized in that the applicator roll is supported on the axle in a central region of its longitudinal extension, and that on either side of the central region there follow axle bore regions extending up to the end faces of the applicator roll in which the latter surrounds the axle with a clearance.

Owing to this mode of support the applicator roll can yield by tilting as well as by parallel shifting and is thus able to conform to the surface to be provided with the label. Therefore, the applicator roll can be made of a hard material which does not deform under the forces occurring during use of the labeling device. The risk that the appearance of the imprint provided on the adhesive label will suffer is therefore substantially reduced, if not eliminated altogether.

In a favorable embodiment the axle bore regions disposed on either side of the central region can conically flare toward the end faces of the applicator roll. By this embodiment the resilience range of the applicator roll is increased.

The axle may favorably consist of a helical spring, or an elastic bar of plastic material the ends of which are spherically enlarged and held in a cylindrical bore, or a plurality of individual steel wires extending in parallel, or of two steel wires twisted around each other.

Suitably the applicator roll may consist of thermoplastic or duroplastic plastic material or of metal.

Examples of the invention will now be explained with reference to the drawing wherein FIG. 1 shows a schematic illustration of a labeling device;

FIG. 2 is a section through a first embodiment of the applicator roll used in the device of FIG. 1;

FIG. 3 is a section through a second embodiment of the applicator roll used in the device of FIG. 1;

FIG. 4 is a section through a third embodiment of the applicator roll used in the device of FIG. 1; and FIG. 5 is a section along the line marked with arrows in FIG. 4.

Figure 1:
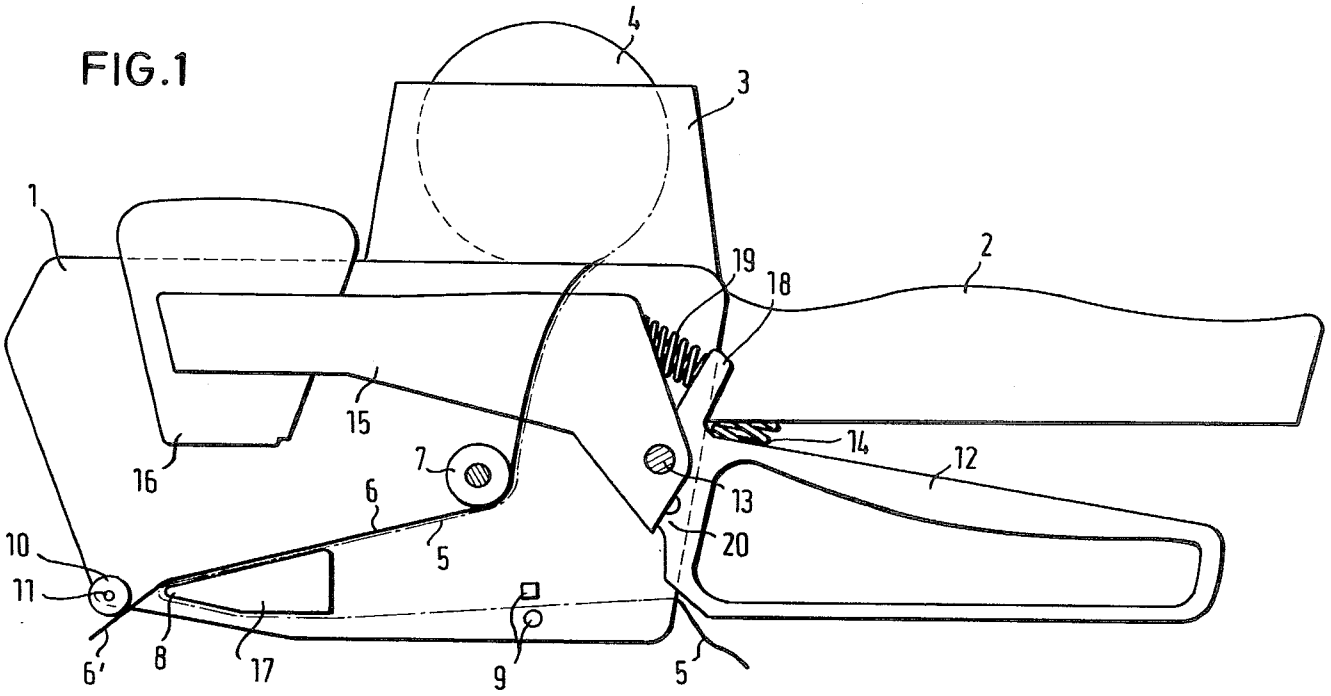

The labeling device illustrated in FIG. 1 comprises a housing 1 to which a handle 2 is attached. In the top of the housing there is a cavity 3 for receiving a supply roll 4 of a backing tape 5 with adhesive labels 6 adhering thereto. The backing tape 5 travels in the device from the cavity 3 at first downwardly and, after deflection about a roll 7, forwardly to a peel edge 8 where the backing tape 5 is deflected and guided past a schematically shown transporting unit 9 to the rear end of the housing. In the housing, in front of the peel edge 8, an applicator roll 10 is mounted for rotation about an axle 11 by which a label 6' detached from the backing tape 5 at the peel edge 8 and ready in dispensing position may be adhered to an article by rolling the applicator roll 10 over the article.

Below the handle 2 an operating lever 12 is provided which is pivotally mounted on axle 13. Between the handle 2 and the operating lever 12 there is a spring 14 tending to constantly urge the operating lever 12 into the inoperative position shown in FIG. 1. In the housing 1 there is also a printer lever 15 which is likewise pivotally mounted on the axle 13. Said printer lever 15 carries a printer 16 by means of which an adhesive label 6 lying on the printing platen 17 can be printed.

Between an arm 18 of the operating lever 12 and the printer lever 15 there is a spring 19 which serves to transmit to the printer lever 15 the movement of the operating lever 12 toward the handle 2. In the inoperative position shown in FIG. 1 the printer lever 15 is held in the lifted position by a nose 20 provided at the operating lever 12.

For brief description of an operating cycle of the device shown in FIG. 1 it is assumed that an adhesive label has not yet arrived in the dispensing position below the applicator roll 10. For initiating an operating cycle the operating lever 12 is pulled toward the handle 2 which causes the printer lever 15 to turn counterclockwise about the axle 13 under the action of the arm 18 and the spring 19 so that the printer 16 is lowered onto the printing platen 17. As the printer 16 hits the printing platen 17 it produces an imprint on the adhesive label 6 lying on the printing platen 17. Simultaneously a lever mechanism, not shown, moves the transporting unit 9 from the position shown in FIG. 1 toward the printing platen 17 along the supporting tape 5. When the operating lever 12 is released the spring 14 moves the operating lever back into the initial position shown in FIG. 1, and at the same time the nose 20 turns the printer lever 15 clockwise about the axle 13 back into its illustrated initial position. At the same time the transporting unit 9 is returned to its initial position shown in FIG. 1; however, during this movement it is in firm engagement with the backing tape 5 so that the latter is drawn about the peel edge 8 a length corresponding to the length of one adhesive label. At the peel edge 8 an adhesive label separates from the backing tape 5 and arrives in the position of the adhesive label 6' below the applicator roll 10. Now the adhesive label 6' can be adhered to an article in that the applicator roll 10 is rolled over said article.

FIG. 2 illustrates one embodiment of the applicator roll 10 and its mode of support. The applicator roll 10 consists of a hard thermoplastic or duroplastic plastic material which does not deform under the forces exerted during application of an adhesive label. In order to minimize contact between the applicator roll 10 and the imprint previously produced on the adhesive label to be applied, the peripheral surface of the applicator roll 10 has annular projections 21 so that there is only linear contact between the roll and the label surface. The axle 11*a*, in the example illustrated in FIG. 2, consists of a helical spring the ends of which are seated in cylindrical bores 22, 23 in the housing 1. The axle 11*a* extends through an axle bore 24 in the applicator roll. This bore 24 has a central region 25 whose diameter corresponds to the diameter of the axle 11*a*. On either side of the central region 25 there are bore regions 26, 27 extending up to the end faces 28 and 29, respectively, of the applicator roll 10. These bore regions 26, 27 have a diameter larger than the diameter of the axle 11*a* so that they accommodate the axle 11*a* with a clearance; they are so designed that they conically flare toward the end faces 28, 29 of the applicator roll 10.

Owing to the special mode of supporting the applicator roll 10 on the axle 11 the applicator roll 10 can readily conform to the surface of the article onto which the printed adhesive label 6' held ready in dispensing position is to be adhered. The bore regions 26, 27 of a diameter larger than the diameter of the axle 11*a* permit a relatively great deflection of the axle which allows for a relatively great displacement of the applicator roll 10. Hence, when applying the adhesive label 6' the operator need not make sure to precisely hold the axle 11*a* in parallel to the surface of the article to which the label is to be adhered, because the described bearing of the applicator roll 10 compensates any tilt of the labeling device and thus of the axle 11*a* relative to the surface to be provided with the label. For adaption to the surface to be provided with a label the applicator roll 10 not only can tilt, it also can yield in parallel direction.

In the embodiment illustrated in FIG. 3 the axle 11*b* consists of an elastic rod of plastic material with spherically enlarged ends which are held in cylindrical bores 22, 23. As shown in the example of FIG. 2, also the axle 11*b* is in contact with the applicator roll 10 only in the central region 25 of the bore 24, while in the bore regions 26, 27 it is surrounded by the applicator roll 10 with a clearance. Also in the example of FIG. 3 the applicator roll can yield so that it still perfectly applies adhesive labels onto surfaces even if the operator holds the labeling device so that the axle 11*b* is not precisely positioned in parallel to the surface to which the label is to be adhered. The spherical ends 30 and 31 of the axle 11*b* which are held in bores 22, 23, respectively, substantially facilitate deflection of the axle under load.

In the example of FIG. 4 the axle 11*c* consists of a bundle of four thin steel wires whose ends are held in the bores 22, 23. Otherwise this example of FIG. 4 exactly corresponds to that of FIG. 2 so that a more detailed description is unnecessary.

It is also possible to use two twisted steel wires as axle in lieu of the helical spring employed in FIG. 2. Since an illustration of such an example would be substantially identical with the example shown in FIG. 2, a separate illustration was forgone.

As explained above, the applicator roll 10 may be made of hard plastic material since the required resilience is attained by its special bearing. It is even possible to make the applicator roll 10 of metal. Moreover, these hard materials offer the advantage of having only low wettability so that they hardly pick up any ink from the imprint made on the label. Hence, such applicator rolls do not impair the appearance of the imprint.

We claim:

1. A labeling device for printing, dispensing, and applying adhesive labels which, during each operating cycle, prints an adhesive label and transports it into a dispensing position below an applicator roll mounted for rotation on an axle elastically deformable under the influence of forces present when the labels are applied, characterized in that the applicator roll (10) is made of thermoplastic or duroplastic material, that the applicator roll (10) is supported on the axle (11, 11*a*, 11*b*, 11*c*) in a central region (25) of its longitudinal extension and that on either side of the central region (25) there follow axle bore regions (26, 27) extending up to the end faces (28, 29) of the applicator roll (10), in which axle bore regions the applicator roll (10) surrounds the axle (11, 11*a*, 11*b*, 11*c*) with a clearance.

2. Labeling device according to claim 1, characterized in that the axle bore regions (26, 27) disposed on either side of the central region (25) conically flare toward the end faces (28, 29) of the applicator roll (10).

3. Labeling device according to claim 1 or 2, characterized in that the axle (11*a*) consists of a helical spring.

4. Labeling device according to claim 1 or 2, characterized in that the axle (11*b*) consists of an elastic bar of plastic material the ends (30, 31) of which are spherically enlarged and are held in a cylindrical bore (22, 23).

5. Labeling device according to claim 1 or 2, characterized in that the axle (11*c*) consists of a plurality of individual steel wires disposed in parallel.

6. Labeling device according to claim 1 or 2, characterized in that the axle consists of two steel wires twisted about one another.

* * * * *